United States Patent [19]

Bussard

[11] Patent Number: 4,635,388

[45] Date of Patent: Jan. 13, 1987

[54] FRAMING HOOP FOR WALL HANGINGS

[76] Inventor: Janice W. Bussard, 201 N. Fruitport Rd., Spring Lake, Mich. 49456

[21] Appl. No.: 823,253

[22] Filed: Jan. 28, 1986

[51] Int. Cl.[4] ..... D05C 1/04

[52] U.S. Cl. ..... 38/102.2; 40/603; D8/373

[58] Field of Search ..... 38/102.2; 40/617, 603, 40/152, 152.1; D8/367, 373; 248/231.2

[56] References Cited

U.S. PATENT DOCUMENTS

D. 135,636 5/1943 Agosta ..... D8/373
610,658 9/1898 Maynard ..... 38/102.2
624,254 5/1899 Rust, Jr. ..... 40/152
1,318,721 10/1919 Boden ..... 38/102.2
1,835,098 12/1931 Shedd ..... 40/152

*Primary Examiner*—Werner H. Schroeder
*Assistant Examiner*—Andrew M. Falik

[57] ABSTRACT

A pair of interfitting hoops for holding a fabric therebetween during needlework application, and a take-up mechanism on the inner ring keeping the interfit frictionally snug; the take-up mechanism being pivotable from a retracted position to an extended position for hanging on a wall hook or nail and displaying the needlework design applied to the fabric.

5 Claims, 7 Drawing Figures

10
11
12
13
14
15
16
17
18
19
20
21
22
23
24
25
26
1b
2b

FRAMING HOOP FOR WALL HANGINGS

BACKGROUND OF THE INVENTION

1. Field of the Invention

This invention relates generally to a craft wherein a pair of interfitted hoops are used for holding a fabric taut therebetween while needlework is being sewn on the fabric. More specifically it relates to needlework hoops which additionally serve afterwards for framing the finished needlework, so as to hang it on a wall as a decorative display.

The present invention is an improvement over my previous U.S. patent application Ser. No. 680,547 filed Dec. 12, 1984 entitled "Framing Hoop For Wall Hangings" which included a compression take-up mechanism for frictionally holding the hoops together, and which was located hidden behind the hoops so as to not visibly detract from the display. However, it did not include any specific wall hanging means.

2. Prior Art

Heretofore such interfitted hoops sometimes come apart during the sewing operation, due to insufficient frictional hold therebetween, so that various means have been tried in the past to solve this problem, including extra holding appendages added on the outer edges of the device, but which visibly detracted when the hoops served as a display frame.

SUMMARY OF THE INVENTION

Accordingly, it is a principal object of the present invention to provide an improved framing hoop for wall hangings which includes a take-up mechanism producing increased frictional hold together of an inner and an outer hoop; the take-up mechanism being reversible in positioning so that in one position it is located behind the two hoops during a sewing operation, and afterwards is located in another position above the two hoops for being convenient to hang on a hook or nail fastened in a wall.

Another object is to provide an improved framing hoop for wall hangings wherein a take-up mechanism functions by spreading apart opposite ends of a partly circular inner hoop located inside a fully circular hoop so as to extend and frictionally hold thereagainst.

Another object is to provide an improved framing hoop for wall hangings wherein the reversibility of a mechanism is quickly and easily accomplished by being simply flipped over without need to disassemble it from the hoops.

Other objects are to provide an improved framing hoop for wall hangings which is inexpensive to manufacture, rugged in construction, and efficient in use.

These and other objects will be readily evident upon a study of the following specification and the accompanying drawing.

BRIEF DESCRIPTION OF THE DRAWING FIGURES

FIG. 1 is a rear view of the assembled invention shown in use while a needlework design is being sewn on a fabric;

FIG. 1*a* is an enlarged detail view thereof shown in a same plane as in FIG. 1;

FIG. 1*b* is a cross sectional view taken on line 1*b*—1*b* of FIG. 1*a* as seen in the direction of the indicated arrows;

FIG. 2 is a rear view of the assembled invention shown after the excess fabric edge is trimmed off and a spring wire loop is flipped over for hanging on a wall;

FIG. 2*a* is an enlarged detail view thereof shown in a same plane as in FIG. 2.

FIG. 2*b* is a cross sectional view taken on line 2*b*—2*b* of FIG. 2*a* as seen in the direction of the indicated arrows; and FIG. 3 is an exploded perspective view of the invention components shown prior to being assembled together.

DETAILED DESCRIPTION OF PREFERRED EMBODIMENT

Figures 1, 1A, 1B, 2, 2A, 2B, 3:
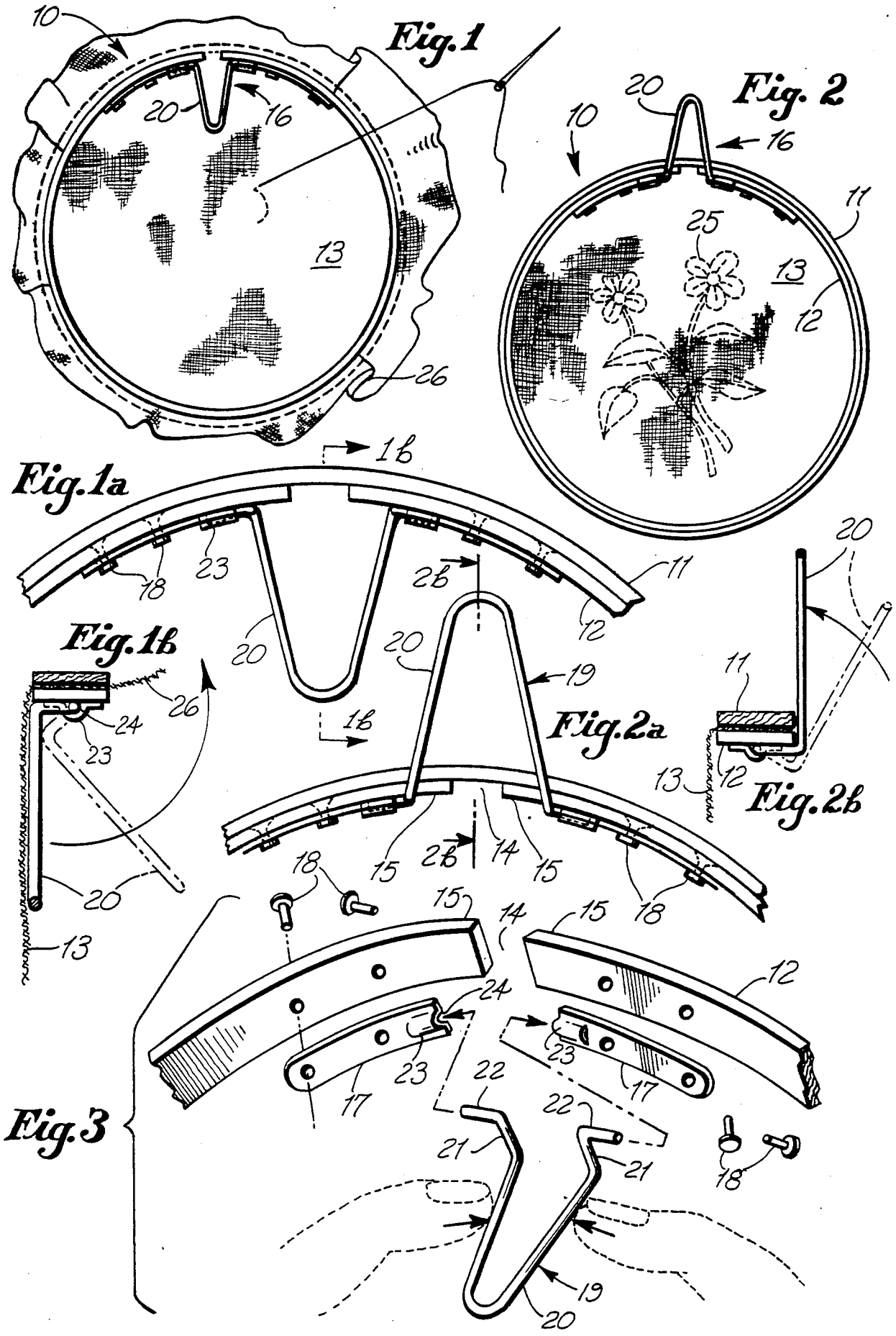

Referring now to the drawing in greater detail, the reference numeral 10 represents an improved framing hoop for wall hangings, according to the present invention wherein there is a circular outer hoop 11 and a circular inner hoop 12 that fits therewithin for holding taut therebetween a fabric sheet material 13 extended across a center of the hoops in order that needlework may be conveniently applied to the fabric. The outer hoop comprises a fully closed band while the inner hoop comprises an open band having a gap 14 between opposite ends 15 thereof. A take-up mechanism 16 bridges across the gap for forcing the inner hoop firmly toward the outer hoop by urging the two ends 15 to spread further apart from each other, and thus causing the inner hoop to expand outwardly against the outer hoop.

The take-up mechanism comprises a metal tab 17 mounted by rivets 18 to each of the inner hoop ends and a metal spring wire loop 19 that is attached between the tabs. The loop includes a "U"-shaped central portion 20 between opposite ends bent at right angles into intermediate leg 21 and end leg 22. The two end legs 22 extend generally parallel to each other in opposite directions along a single common axis about which the loop is pivotable. A ridge 23 is bent up on each tab so as to form a recess 24 therebeneath in which one of the loop end legs 22 pivots.

In operative use, the fabric material is placed flat between the hoops, and the hoops are then interfitted together, clamping the fabric therebetween so as to be held taut while the needlework is applied. During this time the loop is in the retracted position shown in FIG. 1. After the decorative design 25 is applied, the excess fabric edge 26 is trimmed off and the loop is simply flipped outwardly from the retracted position inside the periphery of the inner hoop to an extended position exterior to the periphery of the outer hoop as shown in FIGS. 1*b* and 2*b* so as to be hung up on a wall hook as shown in FIG. 2.

In this invention, the hoops are made of wood or other flexible material and may be made in any size and in any shape, such as square, oval, triangular or the like. A longitudinal tongue and groove may be included for snap interfitting the hoops together. The loop may be made long or short, as preferred by a manufacturer.

While various other changes may be made in the detail construction, it is understood that such changes will be within the spirit and scope of the present invention, as is defined by the appended claims.

What I claim as new, is:

1. An improved framing hoop assembly for wall hangings, comprising, in combination, an outer hoop, an inner hoop for being received in said outer hoop and a take-up mechanism or said inner hoop for snugly fitting said inner hoop against said outer hoop; said outer hoop comprising a circularly closed band and said inner hoop comprising a circularly open band having a gap between opposite ends of said inner hoop, said take-up mechanism bridging said gap, and said take-up mechanism including means for being moved from a retracted position inside the periphery of the inner hoop to an outwardly extended position exterior to the periphery of the outer hoop wherein said snug fitting is still being maintained by said takeup mechanism.

2. The combination as set forth in claim 1, wherein said take-up mechanism comprises a tab mounted on each said end of said inner hoop and a metal spring wire loop between the two said tabs.

3. The combination as set forth in claim 2, wherein said means comprises said spring wire loop being pivotably mounted on said tabs so as to be pivotable between said inside and exterior positions.

4. The combination as set forth in claim 3, wherein said spring wire loop is generally "U"-shaped.

5. The combination as set forth in claim 4, wherein said hoops include snap interfitting means.

* * * * *